US010117548B2

(12) United States Patent
Babikian et al.

(10) Patent No.: US 10,117,548 B2
(45) **Date of Patent: *Nov. 6, 2018**

(54) FOAM PRODUCING APPARATUS AND METHOD

(71) Applicant: BOBRICK WASHROOM EQUIPMENT, INC., North Hollywood, CA (US)

(72) Inventors: Dikran Babikian, Glendale, CA (US); Branko Bem, Plano, TX (US); Epitacio Davila, Reseda, CA (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/336,587

(22) Filed: Oct. 27, 2016

(65) Prior Publication Data

US 2017/0042385 A1 Feb. 16, 2017

Related U.S. Application Data

(63) Continuation of application No. 13/563,558, filed on Jul. 31, 2012, now Pat. No. 9,554,675.

(Continued)

(51) Int. Cl.

*B67D 7/76* (2010.01)
*A47K 5/14* (2006.01)

(Continued)

(52) U.S. Cl.

CPC ..... *A47K 5/14* (2013.01); *A47K 5/06* (2013.01); *A47K 5/16* (2013.01); *B01F 3/04446* (2013.01);

(Continued)

(58) Field of Classification Search

CPC ..... B05B 7/0037; B05B 11/3087; A47K 5/14; A47K 5/16; B67D 7/76; B01F 5/0693;

(Continued)

(56) References Cited

U.S. PATENT DOCUMENTS 3,970,219 A * 7/1976 Spitzer ..... B65D 83/14 222/1
5,064,103 A 11/1991 Bennett (Continued)

FOREIGN PATENT DOCUMENTS

DE 32 47 645 A1 7/1984
EP 0 336 188 A2 10/1989

(Continued)

OTHER PUBLICATIONS

Patent Cooperation Treaty (PCT) International Search Report and Written Opinion of the International Searching Authority dated Nov. 7, 2013, for International Application No. PCT/US2012/049060, filed Jul. 31, 2012; 12 pages.

(Continued)

*Primary Examiner* — Jeremy Carroll
(74) *Attorney, Agent, or Firm* — Lewis Roca Rothgerber Christie LLP

(57) ABSTRACT

A foam dispenser includes a dispensing outlet, a pre-mixing chamber receiving liquid from a liquid source and air from an air source, a mixing chamber downstream of the pre-mixing chamber and proximate the dispenser outlet, and a first conduit coupling the pre-mixing chamber to the mixing chamber.

12 Claims, 4 Drawing Sheets

Related U.S. Application Data

(60) Provisional application No. 61/526,625, filed on Aug. 23, 2011, provisional application No. 61/513,893, filed on Aug. 1, 2011.

(51) Int. Cl.

| | |
|---|---|
| ***A47K 5/16*** | (2006.01) |
| ***B01F 5/06*** | (2006.01) |
| ***B01F 13/10*** | (2006.01) |
| ***B01F 3/04*** | (2006.01) |
| ***A47K 5/06*** | (2006.01) |
| *A47K 5/12* | (2006.01) |

(52) U.S. Cl.
CPC ..... *B01F 5/0693* (2013.01); *B01F 13/1016* (2013.01); *A47K 2005/1218* (2013.01); *B01F 2215/0431* (2013.01)

(58) Field of Classification Search
CPC ..... B01F 13/1016; B01F 3/04446; B01F 2215/0431
USPC ..... 222/190, 1, 145.5, 145.6, 145.7, 189.11, 222/189.08
See application file for complete search history.

(56) References Cited

U.S. PATENT DOCUMENTS

| | | | |
|---|---|---|---|
| 5,071,379 | A | 12/1991 | Poizot |
| 5,842,607 | A | 12/1998 | Snider |
| 6,797,319 | B2 | 9/2004 | Capizzi |
| 8,225,965 | B2 | 7/2012 | Arminak |
| 8,496,142 | B2 | 7/2013 | Uehira et al. |
| 8,991,657 | B2 | 3/2015 | Ciavarella et al. |
| 9,004,318 | B2 | 4/2015 | Kodama et al. |
| 9,072,412 | B2 | 7/2015 | Ciavarella et al. |
| 2007/0114243 | A1 | 5/2007 | Kershaw et al. |
| 2007/0278247 | A1 | 12/2007 | Banks et al. |
| 2012/0067923 | A1 | 3/2012 | Matthews et al. |
| 2013/0048755 | A1 | 2/2013 | Uehira et al. |
| 2013/0102071 | A1 | 4/2013 | Pan et al. |
| 2013/0119083 | A1 | 5/2013 | Ophardt et al. |
| 2013/0200109 | A1 | 8/2013 | Yang et al. |
| 2013/0292419 | A1 | 11/2013 | Quinlan et al. |
| 2013/0292420 | A1 | 11/2013 | Mizushima |
| 2013/0313285 | A1 | 11/2013 | Iizuka et al. |
| 2013/0341358 | A1 | 12/2013 | Ciavarella et al. |

FOREIGN PATENT DOCUMENTS

| | | |
|---|---|---|
| EP | 1 844 690 A2 | 10/2007 |
| WO | WO 00/09251 | 2/2000 |
| WO | WO 03/102301 A1 | 12/2003 |

OTHER PUBLICATIONS

Patent Cooperation Treaty (PCT) International Preliminary Report on Patentability and Written Opinion of the International Searching Authority dated Feb. 4, 2014, for International Application No. PCT/US2012/049060, filed Jul. 31, 2012; 9 pages.

Office action and Examination search report issued in corresponding Canadian Patent Application No. 2843309, dated Mar. 5, 2018, 4 pages.

Extended European search report issued in the corresponding European Patent Application No. 17195689.9, dated Mar. 16, 2018, 5 pages.

* cited by examiner

FOAM PRODUCING APPARATUS AND METHOD

CROSS-REFERENCE TO RELATED APPLICATIONS

The above-referenced application is a continuation application of U.S. patent application Ser. No. 13/563,558, filed Jul. 31, 2012, issued as U.S. Pat. No. 9,554,675 on Jan. 31, 2017, which claims priority to and is based upon U.S. Provisional Application No. 61/513,893, filed on Aug. 1, 2011, and U.S. Provisional Application No. 61/526,625, filed on Aug. 23, 2011, the contents of all three of which are fully incorporated herein by reference.

BACKGROUND

Foam soap dispensers generally form foam by mixing a stream of liquid soap with a stream of air in a chamber under force or pressure. In order to obtain a more homogenous texture of foam, the mixed stream of liquid soap and air is passed through a mesh (or screen) in a mixing chamber to generate the foam. The liquid soap is dispensed using various types of pumps, such as displacement piston pumps, peristaltic pumps, rotary pumps, gear pumps, etc. Similarly, the air is added to the stream by either using a type of pump or by sucking the ambient air into the mixing chamber and mixing it with the liquid soap stream, as is the case in manually operating soap dispensers. As can be seen in FIG. 1, a soap dispenser 10 may be mounted on a counter 12. However, the reservoir 14 for the liquid soap and the air source 16 may be mounted or located a distance away from the actual dispensing location (i.e. the dispensing opening) 18 of a dispenser spout 20. Typical distances can exceed 2 feet. In one type of setting, the dispenser spout 20 typically has a dispensing opening 18 which dispenses the foam. In hands-free operation type of foam dispensers, a sensor such as an infrared sensor 22, is mounted proximate the tip of the dispenser. The sensor 22 senses a user's hand underneath the dispenser, and sends a signal to a controller 24, such as a microprocessor, which in turn sends a signal to operate a pump 26 for pumping the liquid soap from a reservoir 28 and to a pump 27 for pumping the air from a source 30 air into a mixing chamber 32. The controller may be coupled to a power source 25, such as a battery or an electricity source for powering the controller, sensor and/or the pumps. In order to obtain a better texture of foam, one or more screens 34 (typically two or three screens) are placed in the chamber. The distance 36 between adjacent screens is typically within ⅜ of an inch. In cases, such as that shown in FIG. 1 where the liquid and air supply pumping locations are located at a distance from the dispensing opening 18 of the dispenser such that the foam generated by the mixing chamber has to travel at a distance from along a dispensing line 40, as for example at a distance greater than 10 inches, the quality of the foam is significantly reduced by the time it travels from an outlet 38 of the mixing chamber to the dispensing outlet 18. In addition, the foam generated by the mixing chamber that is not pumped out of the dispenser outlet 18 remains within the dispensing line 40 from the mixing chamber to the dispenser outlet. Thus, the next time a user tries to obtain foam, the user obtains the stale foam that has remained within line 40. In some cases, the mixing chamber 34 is placed adjacent to the nozzle foam to avoid the problem indicated above. However, in such dispensers, the quality of the dispensed is strongly dependent on the type of the liquid soap, the mixing ratio of liquid soap with air and the pressure applied to deliver the liquid soap and the air. Consequently, the user is limited to using the type of liquid soap specified by the dispenser manufacturer in order to maintain the quality of the foam promised by dispenser manufacturer. As such, the quality of the foam obtained with these types of dispensers varies from user to user, and may depend on how long the foam has remained within the dispensing line 40. Moreover, these types of dispensers are typically designed for a specific type of liquid soap. Thus, the quality of the foam produced is dependent on the type of liquid soap used. Consequently, a more robust foam dispenser is desired that can produce a more consistent quality of foam even when different types of liquid soap are used.

SUMMARY

In a first exemplary embodiment, a foam dispenser is provided. The foam dispenser includes a dispensing outlet, a pre-mixing chamber for receiving liquid, such as liquid soap, from a liquid source and air from an air source, a mixing chamber downstream of the pre-mixing chamber and proximate the dispenser outlet, and a first conduit coupling the pre-mixing chamber to the mixing chamber. In another exemplary embodiment, the pre-mixing chamber converts liquid received from the liquid source and air received from the air source into an air-liquid mixture, and the air-liquid mixture is delivered to the mixing chamber and converted into foam to be dispensed from the dispensing outlet. In yet another exemplary embodiment, the air-liquid mixture is not in an optimal quality foam state. In a further exemplary embodiment, each of the pre-mixing and mixing chambers include at least one screen. In one exemplary embodiment, the pre-mixing chamber includes a single 100 mesh size screen. In another exemplary embodiment, the mixing chamber includes a 200 mesh size screen and a 300 mesh size screen. In a further exemplary embodiment, the two screens in the mixing chamber are spaced apart by a distance not greater than ¼ inch. In yet a further exemplary embodiment, the two screens in the mixing chambers is spaced apart by a distance not greater than ½ inch. In one exemplary embodiment, the 300 mesh size screen is downstream of the 200 mesh size screen. In yet another exemplary embodiment, the dispenser also includes a second mixing chamber downstream of the pre-mixing chamber and upstream of the mixing chamber. In an exemplary embodiment, the first conduit is connected between the pre-mixing chamber and the second mixing chamber and a second conduit is connected between the second mixing chamber and the mixing chamber. In any of the aforementioned exemplary embodiments, the air source is ambient air, the first conduit has a length of at least six inches, the first conduit has a length of at least a foot, and/or the first conduit has a length of at least two feet.

In another exemplary embodiment, a method of forming soap foam is provided. The method includes delivering liquid soap and air to a mixing chamber proximate a dispensing outlet, converting the liquid soap and air into the foam at the mixing chamber, and dispensing the foam from the outlet. In yet another exemplary embodiment, delivering liquid soap and air to a mixing chamber includes pre-mixing the liquid soap and air creating an air-liquid mixture, and delivering the air-liquid mixture to the mixing chamber. In a further exemplary embodiment, the method includes determining a time span between a previous dispensing of foam and a current dispensing of foam, and the amount of foam being dispensed is related to the time span. In yet a further exemplary embodiment, the method includes determining a time span between a previous dispensing of foam and a current dispensing of foam, and dispensing includes dispensing the foam for a period of time, wherein the period of time is dependent on the time span.

In another exemplary embodiment a foam dispenser is provided having a dispensing outlet, a pre-mixing chamber receiving liquid, such as liquid soap, from a liquid source and air from an air source, a mixing chamber downstream of the pre-mixing chamber and proximate the dispenser outlet, and a first conduit coupling the pre-mixing chamber to the mixing chamber. The pre-mixing chamber receives liquid from the liquid source and air from the air source and converts them into an air-liquid mixture. The air-liquid mixture, which is not in a foam state, is delivered to the mixing chamber and converted into foam to be dispensed from the dispensing outlet. The pre-mixing chamber includes a single coarser screen. The mixing chamber includes a second screen and a third screen. The third screen has coarseness that is finer than the single coarser screen, while the second screen has a coarseness that is coarser than the third screen but finer than the single coarser screen. In another exemplary embodiment, the third screen is downstream of the second screen.

DETAILED DESCRIPTION

Figure 1:
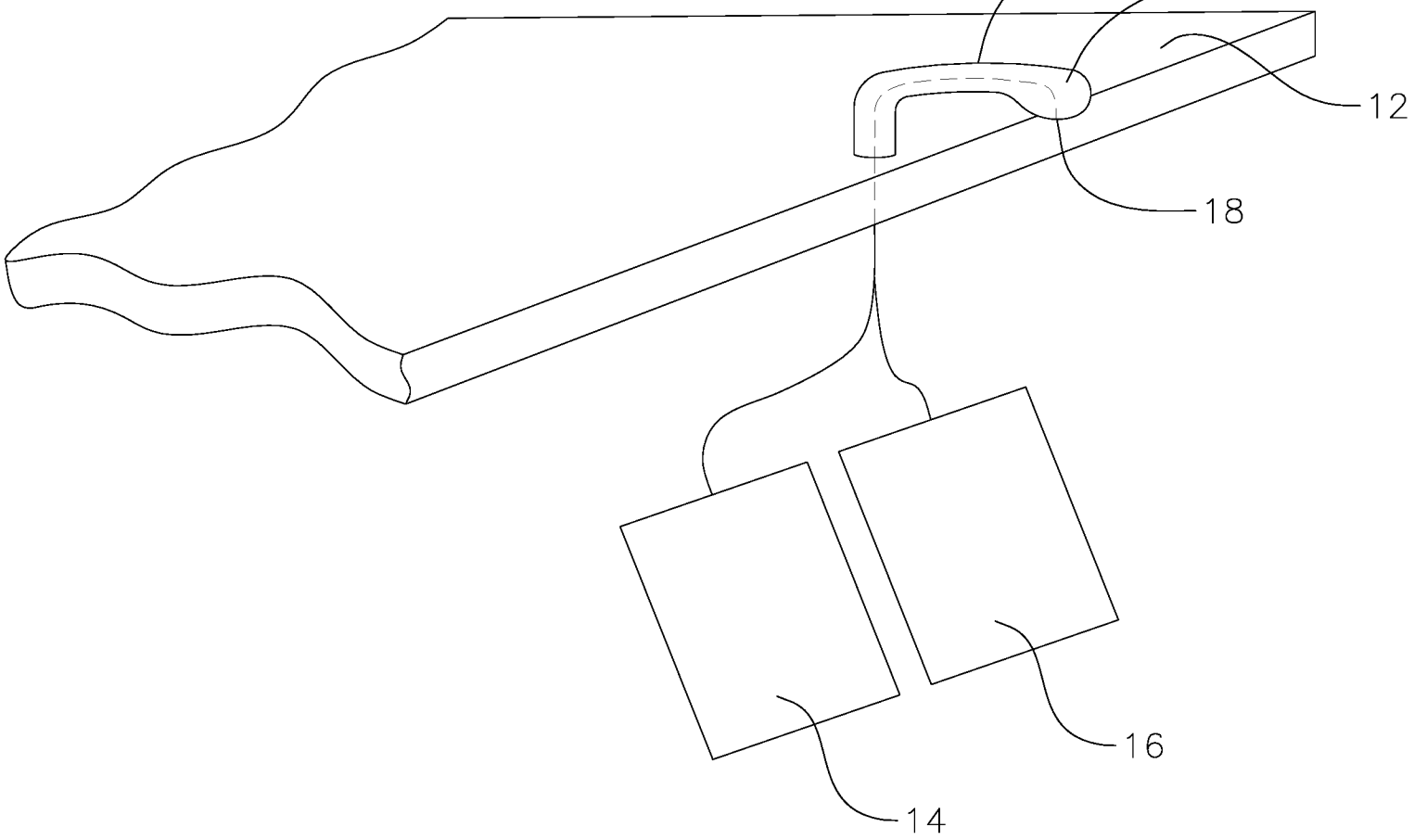
FIG. 1 is a schematically depicted view of a foam dispenser mounted on a counter.
Figure 2:
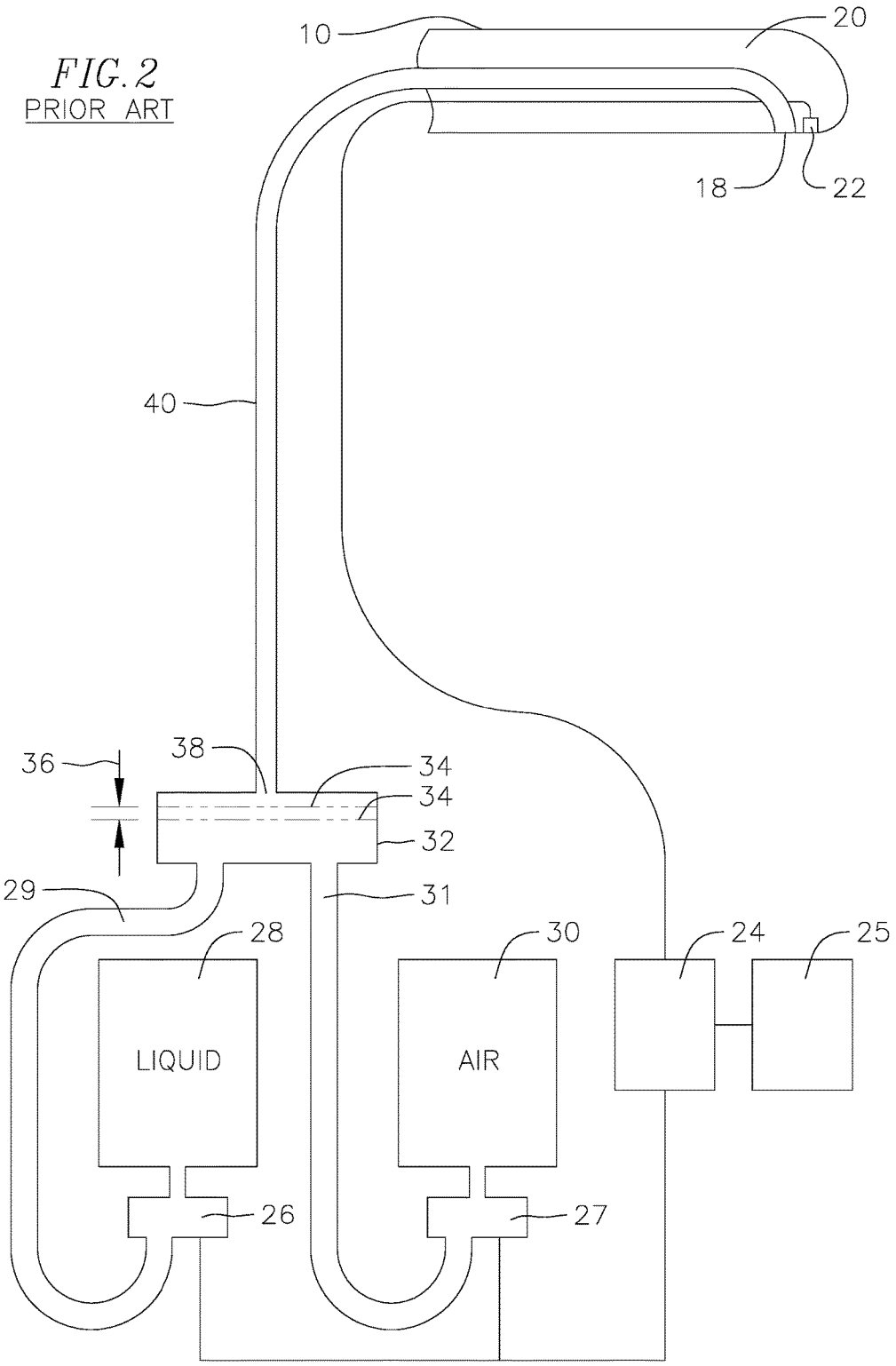
FIG. 2 PRIOR ART
FIG. 2 is a schematically depicted prior art foam dispenser.
Figure 3:
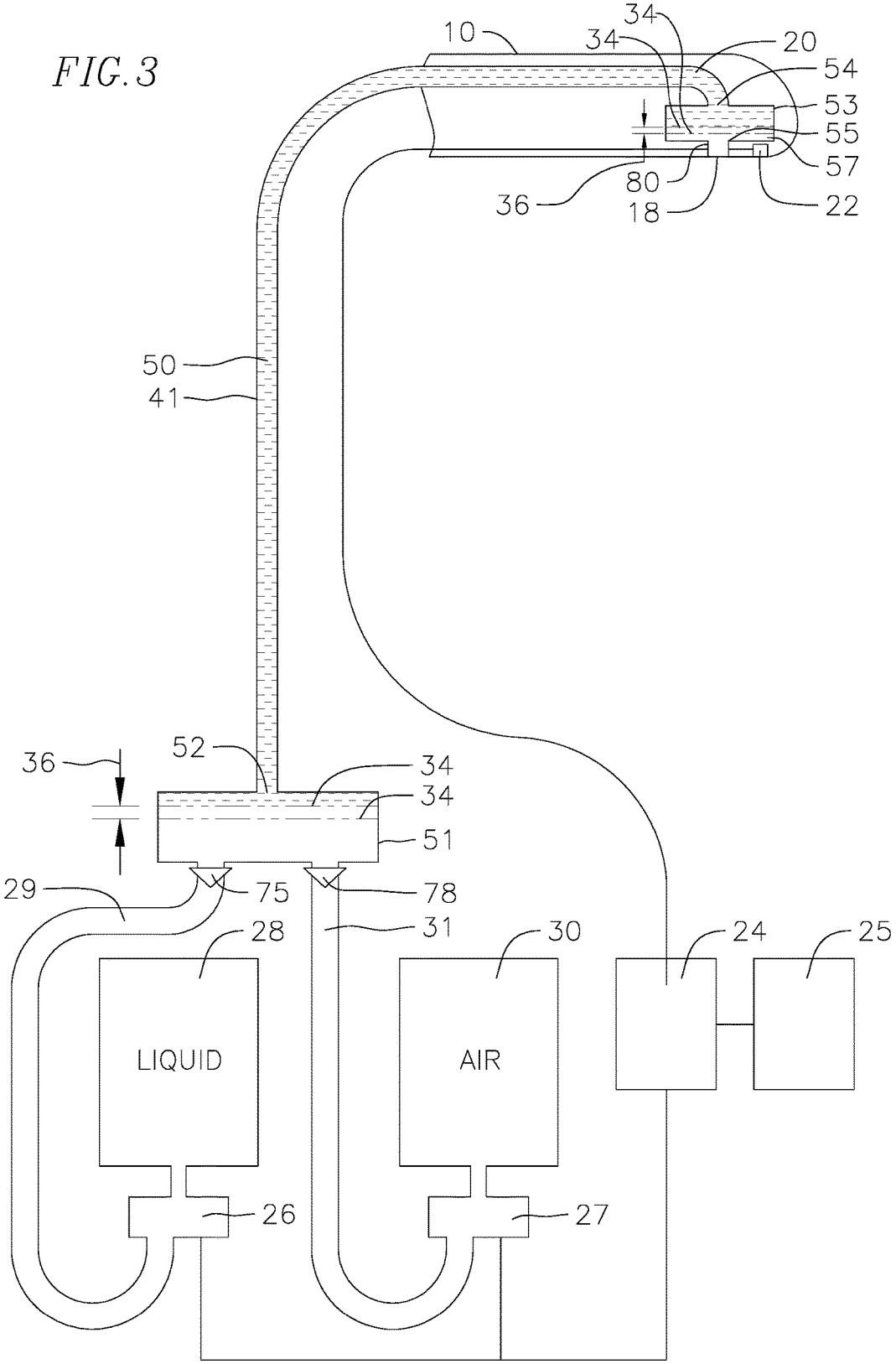
FIG. 3 is a schematically depicted exemplary embodiment foam dispenser of the present invention.

To overcome the problems of the prior art foam dispensers, applicants have invented a foam dispenser which utilizes two or more mixing chambers. FIG. 3 discloses an exemplary embodiment foam dispenser of the present invention. For convenience, the same reference numerals are used to denote the same components in the foam dispenser shown in FIG. 3, as the foam dispenser of the prior art disclosed in FIG. 2. With the exemplary embodiment, a first mixing chamber 51 (also referred to herein as a "premixing chamber") is provided to receive the liquid soap from the liquid soap reservoir or liquid source 28 and air from the air source 30. The air source may be the ambient air. A second mixing chamber 53 is provided downstream from the first mixing chamber proximate the dispenser outlet 18. Each of the mixing chambers may include one or more mixing screens 34. In the exemplary embodiment shown in FIG. 3, each mixing chamber includes two screens 34. In another exemplary embodiment, the first mixing chamber has one screen and the second mixing chamber has two screens. In another exemplary embodiment, the first mixing chamber has a single 100 mesh size screen, while the second chamber has a 200 mesh size and a 300 mesh size screen. In one exemplary embodiment, the 200 mesh size screen is about ½ inch away from the 300 mesh size screen. In a further exemplary embodiment, the 200 mesh size screen is about ¼ inch away from the 300 mesh size screen. In another exemplary embodiment, the 300 mesh size screen is downstream from the 200 mesh size screen. In a further exemplary embodiment, the first mixing chamber has a single relatively coarse screen, while the second chamber has a relatively medium coarseness screen and a relatively fine coarseness screen. In one exemplary embodiment, the 200 mesh size screen or the medium coarseness screen is about ½ inch, and in another embodiment about ¼ inch, away from the 300 mesh size screen or the fine coarseness screen. In another exemplary embodiment, the 300 mesh size screen or the fine coarseness screen is downstream from the 200 mesh size screen or the medium coarseness screen. However, one, or more than two, screens may be incorporated in both or either one of the mixing chambers. If more than one screen is used, applicants have discovered that they can improve on the quality of the foam by keeping the proximity or the distance 36 between adjacent screens to 1 inch or less, ½ inch or less, or even ¼ inch or less.

In the exemplary embodiment shown in FIG. 3, once the sensor 22 senses the existence of a target in its field of activation as for example, the user's hands, it sends a signal to the processor 24 which in turns sends a signal to operate the pumps 26 and 27 for pumping liquid soap and air from the sources 28 and 30, respectively, through conduits 29 and 31, respectively, to the first mixing chamber 51. An one-way valve 75, 77 may be provided along each of the conduits 29, 31, respectively, to prevent backward flow from the first mixing chamber 51 through the conduits 29, 31. At the first mixing chamber, the liquid soap and air are pre-mixed to form a air-liquid mixture 50 which moves through conduit 41 to the second mixing chamber. This air-liquid mixture is not in an optimal quality foam state. The air-liquid mixture then enters to the second mixing chamber 53 where it is converted into an optimal quality foam and is dispensed through outlet 18 on the dispenser. "Optimal quality foam" as used herein means a foam that has a homogenous mixture free from noticeable air bubbles and without having a liquid like texture. An "optimal quality foam" will remain on the surface of a person's hand and not run down when the person's palm is at an angle. It remains on the surface of the person's palm even when the person's hand is turned upside down. The first mixing chamber 51 can be placed at any distance from the liquid and air pumps or sources. In an exemplary embodiment, the conduit 29 has a length from the outlet of the liquid source to the inlet of the first mixing chamber of about a foot and the conduit 31 has a distance from the outlet of the air source to the inlet of the first mixing chamber of about a foot. In an exemplary embodiment, the second mixing chamber 53 is placed within two inches from the dispenser outlet 18. In other words the length of a conduit 55 from the second mixing chamber outlet 55 to the dispenser outlet 18 is two inches or less. In one exemplary embodiment, such length of the conduit 57 is one inch or less. The length of the dispensing conduit 41 between the outlet 52 of the first mixing chamber and the inlet 54 of the second mixing chamber, in an exemplary embodiment, is more than one foot. In another exemplary embodiment, it is more than six inches. In yet another exemplary embodiment, it is at least two feet, and in another exemplary embodiment, it is at least three feet.

The first mixing chamber is used to create a consistent mixture of liquid and air which is then fed to the second mixing chamber for being converted to an optimal quality of foam. In this regard, the dispensing system of the present invention is not limited to any specific type of liquid soap as the liquid soap is pre-mixed with air to form an air-liquid mixture which is not in a complete foam state. It is this air-liquid mixture that is then converted to the optimal quality of foam as it passes through the second mixing chamber. Moreover, because the second mixing chamber is located immediately adjacent to the outlet 18 of the dispenser, the quality of the foam is more consistent, since it is just created and does not reside in any tubing, nor does it have to travel significant distances, prior to dispensing. However, it may be that when a period of time, as for example five minutes or greater between subsequent dispensing operations, occurs, the air-liquid mixture 50 within conduit 41 may change in consistency and may result in a lesser quality foam. Thus, the controller 24 may, in an exemplary embodiment, be programmed such that if after a pre-determined period of time of non-use, as for example five minutes, the first time that it dispenses foam after such non-use, the dispensing time is increased so as to ensure that all the air-liquid that resided in the conduit 41, and possible some of a freshly generated air-liquid, is converted foam by the second mixing chamber and dispensed during such dispensing cycle.

Figure 4:
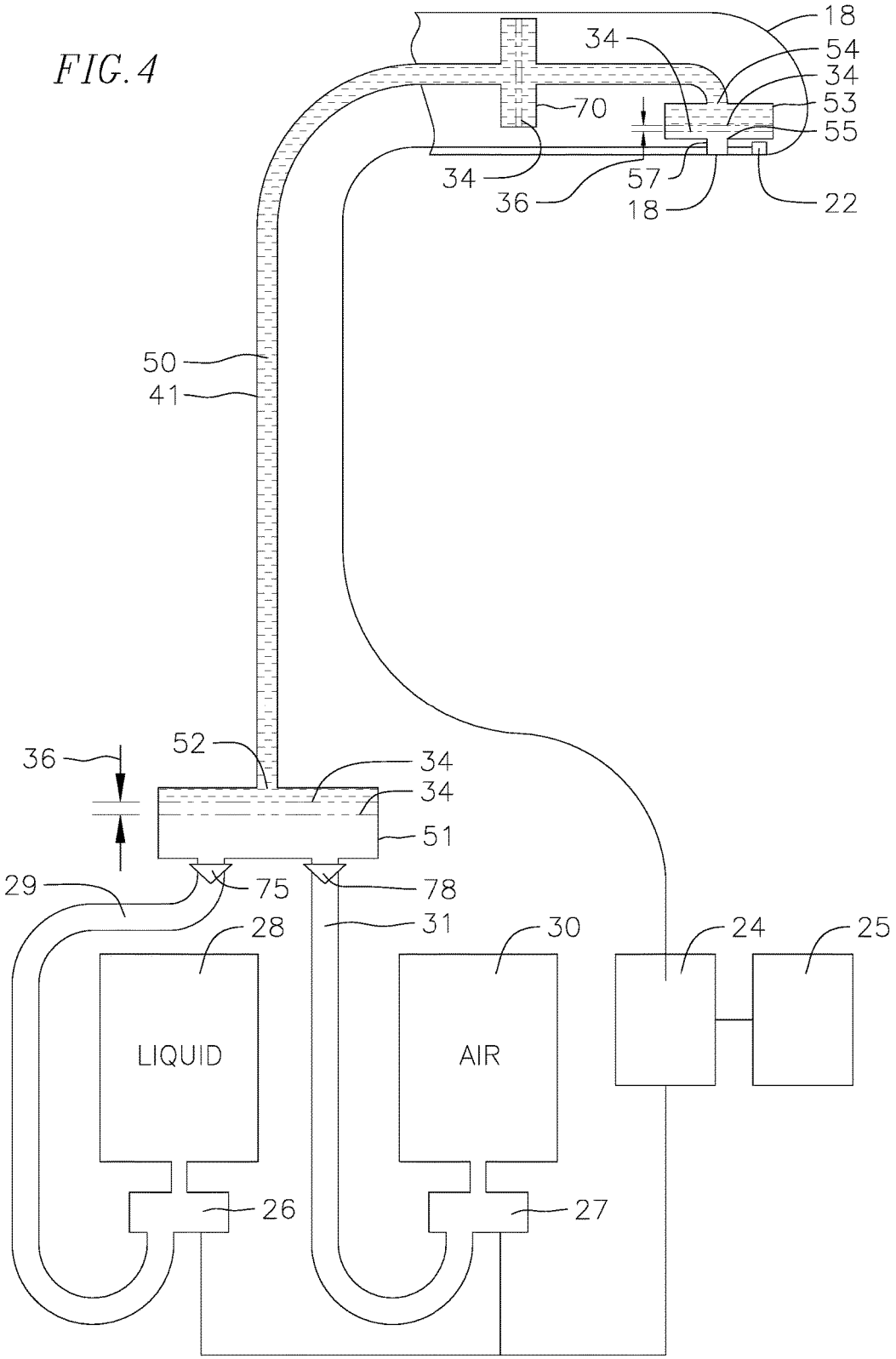
FIG. 4 is another schematically depicted exemplary embodiment foam dispenser of the present invention.

In another exemplary embodiment, a third mixing chamber 70 may be provided between the first and second mixing chambers 51, 53, as for example shown in FIG. 4. The third mixing chamber may have one or more mixing screens, and preferably two or more mixing screens. In other words, in another exemplary embodiment, three or more mixing chambers may be used. Applicant has discovered that it can obtain an optimal quality of foam consistently by using two mixing chamber, a pre-mixing chamber such as the first mixing chamber 51 having a single 100 mesh size screen, and second mixing chamber such as mixing chamber 53 located within two inches (and in an exemplary embodiment, within one inch) from the dispenser outlet and having a 300 mesh size screen about ½ inch, or ½ to ¼ inch downstream from a 200 mesh size screen.

This invention has been described for illustration purposes for use with a hands-free dispenser which uses a sensor to sense a target, such as a person's hands, such as an infrared sensor. However, the same system may be used in to a manually operated dispenser, where the dispenser spout 10 may be pushed to create a pumping action for pumping liquid as well as air which in such case would be sucked by the pumping action. In another exemplary embodiment, the dispenser may be electro-mechanical, as for example the user presses the dispenser spout 10 or a switch which in turn sends an electrical signal to the pumps to operate the pumps for pumping the liquid soap and the air.

As can be seen with the exemplary embodiment, a more consistent type of foam is obtained, unlike the prior art dispensers which are not robust and which may be full of large air bubbles and/or include high liquid content.

With the exemplary embodiment foam dispensers of the present invention applicants have discovered that they can obtain a consistent good quality foam independent of the distance between the dispenser outlet and the liquid soap source and/or the air source.

Although the present invention has been described and illustrated in respect to exemplary embodiments, it is to be understood that it is not to be so limited, since changes and modifications may be made therein which are within the full intended scope of this application.

What is claimed is:

1. A hand soap foam dispenser comprising:

a dispensing outlet for dispensing foam to a person's hand;

a pre-mixing chamber for receiving liquid from a liquid source and air from an air source;

at least one pump for simultaneously pumping liquid from the liquid source and air from the air source to the pre-mixing chamber;

a mixing chamber downstream of the pre-mixing chamber; and a first conduit coupling the pre-mixing chamber to the mixing chamber, wherein foam leaving the mixing chamber travels a distance two inches or less to the dispensing outlet.

2. The dispenser as recited in claim 1, wherein the foam leaving the mixing chamber travels a distance one inch or less to the dispensing outlet.

3. The dispenser as recited in claim 2, wherein each of said pre-mixing chamber and mixing chamber comprises at least one screen.

4. The dispenser as recited in claim 3, wherein the pre-mixing chamber comprises a single 100 mesh size screen.

5. The dispenser as recited in claim 4, wherein the mixing chamber comprises a 200 mesh size screen and a 300 mesh size screen.

6. The dispenser as recited in claim 5, wherein the two screens in the mixing chamber are spaced apart by a distance not greater than ½ inch.

7. The dispenser as recited in claim 6, wherein the 300 mesh size screen is downstream of the 200 mesh size screen.

8. The dispenser as recited in claim 3, wherein the mixing chamber comprises a 200 mesh size screen and a 300 mesh size screen.

9. The dispenser as recited in claim 2, further comprising a second mixing chamber downstream of the pre-mixing chamber and upstream of the mixing chamber.

10. The dispenser as recited in claim 2, wherein the air source is ambient air.

11. The dispenser as recited in claim 2, wherein the first conduit has a length of at least six inches.

12. The dispenser of claim 2, wherein said at least one pump comprises two pumps, a first pump for pumping said liquid soap and a second pump for pumping said air.

* * * * *